US007815157B2

(12) United States Patent
Knight et al.

(10) Patent No.: US 7,815,157 B2
(45) Date of Patent: Oct. 19, 2010

(54) REINFORCING POLES

(75) Inventors: John Keith Knight, Donvale (AU); Robert Edwin Randell, Ferntree Gully (AU); Carmel Geraldine Chell, Wantirna South (AU)

(73) Assignee: Andoria Pty. Ltd., Queensland (AU)

( * ) Notice: Subject to any disclaimer, the term of this patent is extended or adjusted under 35 U.S.C. 154(b) by 177 days.

(21) Appl. No.: 11/577,841

(22) PCT Filed: Oct. 10, 2005

(86) PCT No.: PCT/AU2005/001545

§ 371 (c)(1),
(2), (4) Date: Nov. 21, 2008

(87) PCT Pub. No.: WO2006/045141

PCT Pub. Date: May 4, 2006

(65) Prior Publication Data

US 2009/0152434 A1 Jun. 18, 2009

(30) Foreign Application Priority Data

Oct. 25, 2004 (AU) ..... 2004906121

(51) Int. Cl.

| | |
|---|---|
| ***A47B 96/06*** | (2006.01) |
| ***A47G 29/00*** | (2006.01) |
| ***A47K 1/00*** | (2006.01) |
| ***E04G 3/00*** | (2006.01) |
| ***E04G 5/06*** | (2006.01) |
| ***F21V 21/00*** | (2006.01) |
| ***F21V 35/00*** | (2006.01) |
| ***F16M 13/00*** | (2006.01) |
| ***E04H 17/00*** | (2006.01) |
| ***E02D 27/42*** | (2006.01) |

(52) U.S. Cl. ..... 248/219.4; 248/545; 248/544; 256/65.14; 256/DIG. 5; 256/65.03; 52/170

(58) Field of Classification Search ..... 248/219.4, 248/545, 544; 256/65.14, DIG. 5, 65.03; 182/187; 52/170, 153, 154, 733.2, 736.1, 52/737.3, 731.7

See application file for complete search history.

(56) References Cited

U.S. PATENT DOCUMENTS

| | | | | |
|---|---|---|---|---|
| 1,817,342 A | | 8/1931 | Beecher | |
| 3,738,072 A | * | 6/1973 | Adrian | 52/170 |
| 4,598,512 A | * | 7/1986 | Chapman | 52/165 |
| 4,697,396 A | | 10/1987 | Knight | |
| 4,756,130 A | * | 7/1988 | Burtelson | 52/170 |

(Continued)

*Primary Examiner*—Anita M King
*Assistant Examiner*—Christopher Garft
(74) *Attorney, Agent, or Firm*—RatnerPrestia

(57) ABSTRACT

A method for reinstating a pole standing in ground comprising, abutting an inner surface of a sleeve against an outer surface of the pole so as to have a lower portion of the sleeve penetrating the ground and an upper portion of the sleeve projecting above the ground, and sliding a secondary member against an outer surface of the sleeve so that the secondary member locates against the sleeve and projects above the ground and into the ground, wherein the construction is such that the sleeve and secondary member located against the sleeve jointly form a bridging beam incorporating a box section reinforcement of the bridging beam. The formation of this box section substantially improves the strength of the bridging beam above what would be expected from the strength of the individual components.

16 Claims, 5 Drawing Sheets

U.S. PATENT DOCUMENTS 4,881,355 A * 11/1989 Bosl et al. ..... 52/506.07
4,987,718 A * 1/1991 Knight ..... 52/741.14
5,815,994 A * 10/1998 Knight et al. ..... 52/170
6,079,165 A * 6/2000 Bingel et al. ..... 52/170
7,363,752 B2 * 4/2008 Bingel et al. ..... 52/835
7,415,808 B2 * 8/2008 Bingel et al. ..... 52/834

* cited by examiner

REINFORCING POLES

FIELD OF THE INVENTION

This invention relates to methods for reinstating poles with reinforcing bridging beams and to bridging beam constructions.

BACKGROUND OF THE INVENTION

The use of bridging beams to reinstate poles used by utilities for carrying communications lines, electric power lines and the like has become an effective means for extending the lifetime of damaged, rotted or weakened poles. The term reinstatement as used herein is also to be understood as including reinforcement. Whilst bridging beams have specifically been used to reinstate poles used by utilities, it is to be appreciated that this technique has application to other forms of poles including pylons, stumps, flagpoles, warning posts and the like and as such, the invention also has application in these alternative situations.

Bridging beams have particular application to wooden poles. It is well known that a wooden pole is most vulnerable to rot, decay or similar degradation at about ground level including the area from slightly above to slightly below the ground line of the standing poles. This is the area in which rot generally begins and as the decay spreads, the pole is weakened. If a utility pole should fail, there may be serious disruption to telecommunications and/or power supply. Further, the sudden failure of a pole is a risk which linesman working on such poles face regularly. In addition to the risks of a faulty pole falling and bringing down not only the lines but also the linesman with it, there are risks to passersby and neighbouring buildings or other structures. Similar dangers and inconvenience may result from the failure of poles used in other applications.

Thus, the reinstatement of damaged poles is an important consideration. However, it can be difficult to properly identify damage to a pole. Accordingly it may sometimes be necessary or advisable to provide added strength to a sound pole. The terms reinstate and reinstatement are accordingly used herein to refer to the addition of strength to a pole irrespective of whether the pole has been previously damaged and/or weakened in any way.

Typically, a pole may be reinstated by securing a pre-assembled structurally strong bridging beam to the surface of a pole over the region where it is rotted or weakened. The bridging beam may be securely attached by drilling holes diametrically through the pole and securing the bridging beam to the pole by bolts extending completely through the material of the pole. Where a pole is particularly weakened, two or even more bridging beams may be applied in this fashion.

In another approach the bridging beam simply comprises a very strong steel sleeve which is applied against the side of a pole and secured by means of strapping, bolts, screws, ferrules, backing plates or combinations of these. Of course, in order to provide adequate strength, a simple sleeve forming a bridging beam needs to be manufactured from a heavy gauge steel.

Whilst the various approaches which have been tried for reinstating poles have been used with a measure of success, they generally suffer from one or more disadvantages depending upon the circumstances of use and the economics of use of particular styles of bridging beams in different situations.

There is always room for alternative constructions which may be optimal for a range of situations in which the current styles of bridging beams suffer from disadvantages. Thus, the invention seeks to provide an alternative method for installing bridging beams and bridging beam constructions which may be used for operation of such methods.

DISCLOSURE OF THE INVENTION

The invention provides in one aspect, a method for reinstating a pole standing in ground comprising, abutting an inner surface of a sleeve against an outer surface of the pole so as to have a lower portion of the sleeve penetrating the ground and an upper portion of the sleeve projecting above the ground, and sliding a secondary member against an outer surface of the sleeve so that the secondary member locates against the sleeve and projects above the ground and into the ground, wherein the construction is such that the sleeve and secondary member located against the sleeve jointly form a bridging beam incorporating a box section reinforcement of the bridging beam.

The method may suitably involve securing the bridging beam to the pole. This may be achieved by means such as strapping surrounding the bridging beam and pole, and/or screws or bolts and/or ferrules and/or backing plates for attaching the bridging beam to the pole.

Suitably the secondary member is secured to the sleeve to form the box section. This may occur as a result of the steps taken to secure the bridging beam to the pole or as the result of separate steps to secure the sleeve and secondary member together.

Where strapping is used to secure the bridging beam, the strapping may comprise one or more straps of flexible material. The strapping material may extend through holes formed in the bridging beam. The holes may be formed in the sleeve and/or the box section. Typically, the strapping material may comprise a flexible metal strip. Suitably between two and twelve straps may be used to secure the bridging beam to the pole. More preferably four to eight straps may be used. The straps may be arranged at different positions along the length of the pole.

Where bolts are used, they may be arranged so that they extend into and through the pole and the bridging beam. Typically, between two and twelve bolts, more preferably four to eight bolts may be used to secure a bridging beam with bolts through holes drilled through the pole. The bolts may be used in association with ferrules and/or backing plates as is known in the art.

In another aspect, the invention provides a bridging beam comprising a sleeve having an inner surface for abutting against a pole, locating means on an outer surface of the sleeve, and a secondary member slidable into reinforcing engagement with the locating means, wherein the secondary member is shaped such that it jointly forms a reinforcing box section with the sleeve when it is slid into reinforcing engagement with the locating means.

The box section may extend for any length of the bridging beam.

The locating means may comprise a lip. The lip may extend lengthwise along at least one edge of the sleeve. Suitably, the lip extends lengthwise along both edges of the sleeve. In one particular embodiment, the lip may be formed as a channel shaped section.

The secondary member may be in the form of a generally C-shaped elongate member having two lengthwise edges arranged to fit into a recess formed between the lip and sleeve. Thus, the lip may serve to guide the secondary member along the sleeve as it is slid into position. Where the lip is in the form of a channel section, it may also serve to hold the secondary member in place. In such an instance, the secondary member may have an edge profile which is complementary to the shape of the channel section to facilitate locking of the secondary member to the sleeve after it has been slid into place. This complementary shape may take the form of a flange running lengthwise along both edges of the secondary member.

Whilst it is to be appreciated that the components of the bridging beam may be formed of any materials having adequate strength and weather resistance, it is anticipated that the sleeve and secondary member may typically be formed of a metal such as steel. Moreover, from an economic point of view, it is anticipated that the metal will have been shaped using a sheet metal pressing rather than a rolling process. Thus, it is anticipated that both these components will have a series of corners forming their shape rather than a continuous rounded effect as would be expected using a roll forming process. Whilst pressing is a suitable option, in some instances it may be more suitable to use a rolling process.

Preferred aspects of the invention will now be described with reference to the accompanying drawings.

DETAILED DESCRIPTION OF THE PREFERRED EMBODIMENTS

Figure 3:
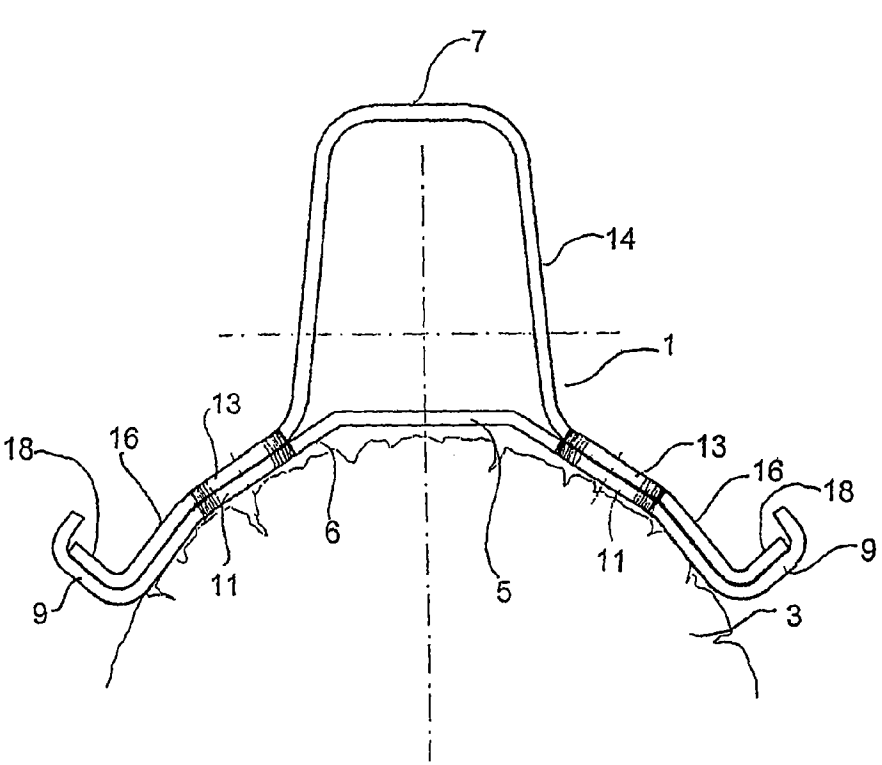
FIG. 3 shows an enlarged fragmentary section of bridging beam and pole taken through the bridging beam of FIG. 1.

The various elements identified by numerals in the drawings are listed in the following integer list.

INTEGER LIST

Figure 2:
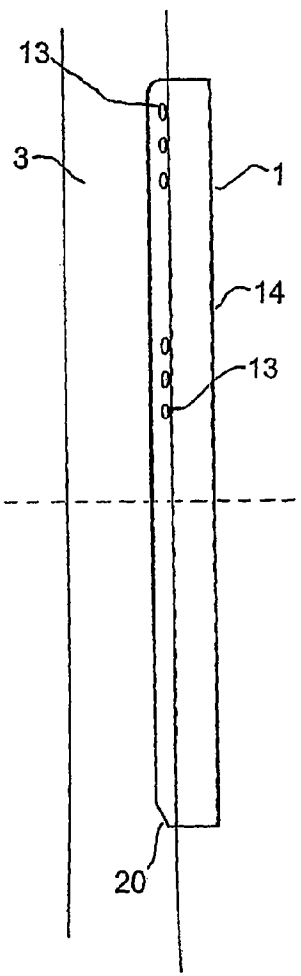
FIG. 2 shows the bridging beam pole of FIG. 1 wherein the pole has been rotated about its lengthwise axis by 90°.
Figure 1:
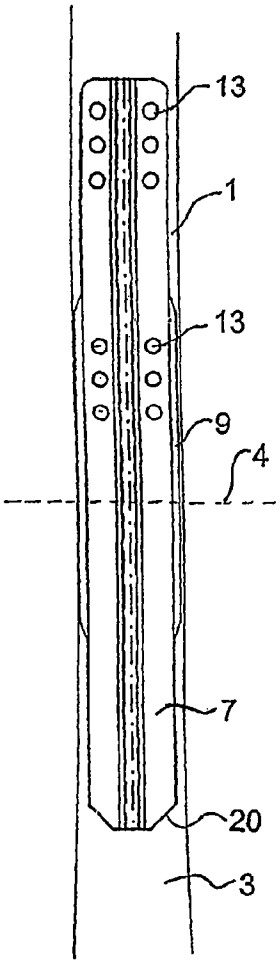
FIG. 1 shows a front on elevational view of a bridging beam secured to a pole.

1 Bridging beam
3 Pole
4 Ground level
5 Sleeve
6 Central portion
7 Secondary member
8 Nail hole
9 Channel section
11 Hole
13 Hole
14 Raised portion
16 Wing section
18 Flange
20 Tapered end
60 Bridging beam
63 Pole
64 Sleeve
66 Secondary member
68 Press bend
70 Press bend
71 Press bend
73 Flange
75 Strapping
76 Connector
77 Bridging beam
78 Secondary member
80 Extended leg
81 Reverse bend Referring to FIGS. 1 to 3, there is shown a bridging beam generally designated 1 reinforcing a pole 3 standing upright in the ground.

It can be seen that the bridging beam extends above and below ground level 4 as it is generally at about ground level that damage to poles through rotting or other means will usually occur.

The bridging beam comprises a sleeve 5 which extends lengthwise along the pole and typically covers about a quarter of the circumference of the pole. The sleeve will have been put in place next to the pole by aligning it up against the pole with the bottom of the sleeve at ground level and driving the sleeve parallel to the pole directly into the ground so that the bottom of the sleeve is below ground level and the top of the sleeve projects above the ground level 4 as is shown in the drawing.

The sleeve itself may be constructed of any suitable material such as pressed or rolled steel.

The sleeve is formed with a central portion 6 which may stand proud of the pole near its mid point, thus giving room for a hammer or similar device to drive the top of the sleeve to push the sleeve into the ground next to the pole. A wider step or flange (not shown) may be provided at the top of the sleeve to give a larger surface for "hammering" the sleeve into the ground. It includes a nail hole 8 to nail the sleeve against the pole when it has been hammered into position.

Opposite edges of the sleeve are formed with channel sections 9 which extend above and below the ground for the entire length of the sleeve. Of course it is to be appreciated that it is possible to construct the sleeve with longer or shorter channel sections as is required.

Holes 11 are provided in the sleeve to allow the sleeve to be secured to the pole by drilling holes through the pole and using bolts to secure the bridging beam securely to the pole.

Thus, the secondary member which acts as a reinforcing element of the bridging beam 1 includes complementary holes 13 arranged to line up with the holes 11 of the sleeve when the two are fitted together in the manner shown in the drawings. The bolts may sit in ferrules extending through the holes 11, 13 and into the drilled holes.

The secondary member is typically formed of the same material as the sleeve eg. steel. It includes a raised portion 14 in its central section and winged sections 16 provided on either side of the raised portion.

Flanges 18 are provided lengthwise along the edges of the wing sections 16, the shape and length of the flanges being chosen so that they can slide easily within the channel section 9 on either side of the sleeve. The flanges are shaped so as to co-operate with the channel sections to hold the secondary member in locking engagement against the sleeve after the secondary member has been slid into position.

Thus, after the sleeve has been driven into the ground next to the pole, the secondary member is similarly driven into the ground in sliding engagement with the sleeve, the channel sections holding the secondary member to the sleeve whilst guiding it as the secondary member is being driven into the ground.

The bottom of the bridging beam is formed with a tapered end reflected in the shape of the bottom of the secondary member to facilitate driving of the secondary member into the ground in the manner illustrated. Furthermore, it can be seen that the two components when locked together form a box section therebetween defined by the raised portion 14 of the secondary member and the central portion of the sleeve. The formation of this box section substantially improves the strength of the bridging beam above what would be expected from the strength of the individual components. Thus, the individual components may be sized and formed from a gauge of steel less than would otherwise be required if the reinforcing feature of the box section was not included.

Figure 5:
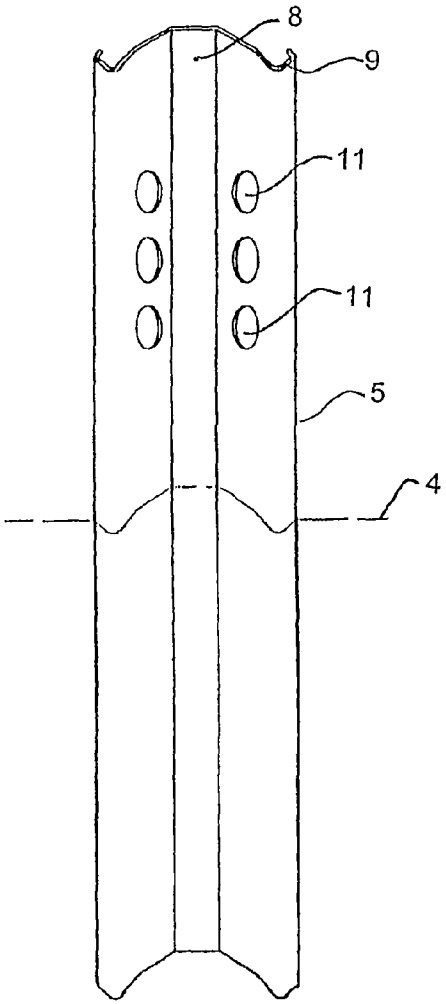
FIG. 5 shows a view of the sleeve of FIG. 4 rotated about its lengthwise axis through 180°.
Figure 4:
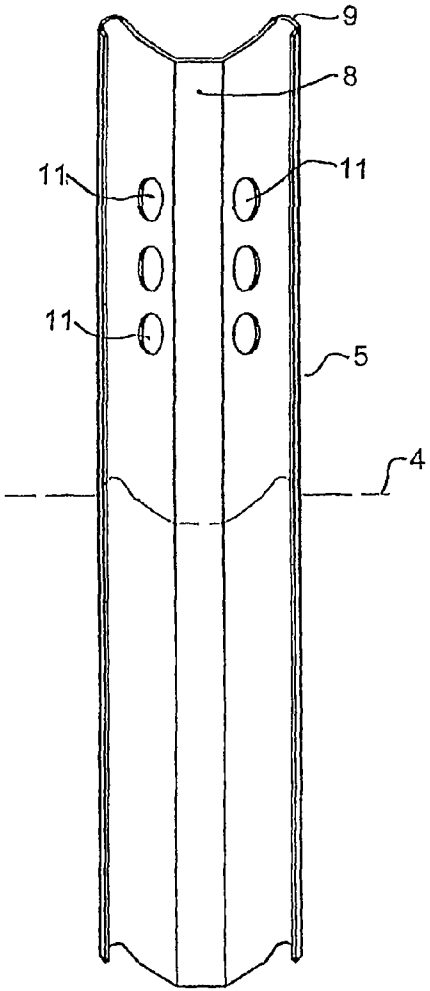
FIG. 4 shows an elevation of a sleeve for construction of a bridging beam in accordance with the invention.

Referring to FIGS. 4 and 5, there is shown the sleeve construction which is used in the bridging beam described with reference to FIGS. 1 to 3. The sleeve is shorter than the secondary member and only has one group of six holes 11 as compared with the two sets of six holes in the secondary member of FIGS. 1 to 3.

Figure 6:
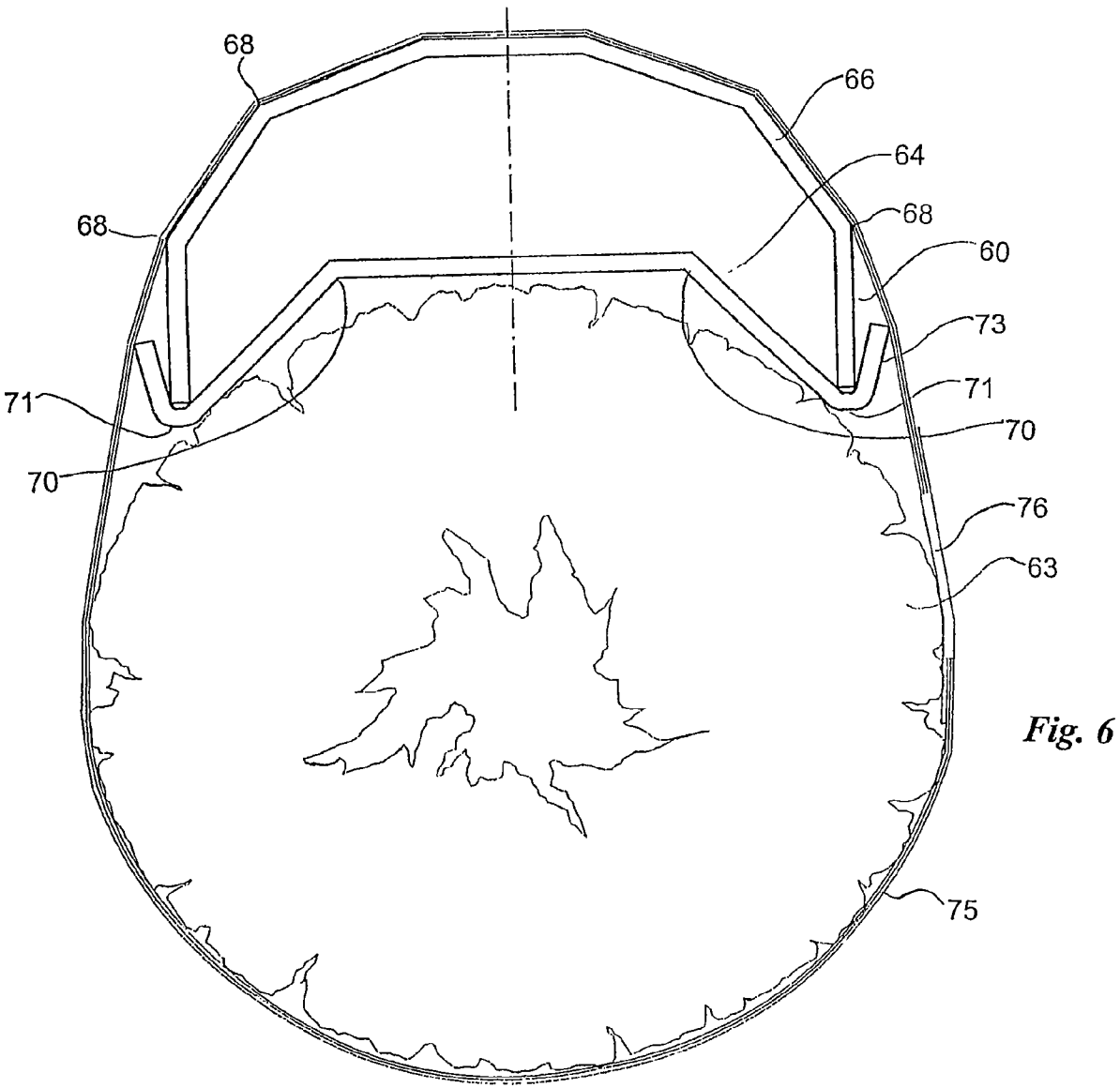
FIG. 6 shows a cross section of an alternative bridging beam construction according to the invention applied to a pole.
Figure 9:
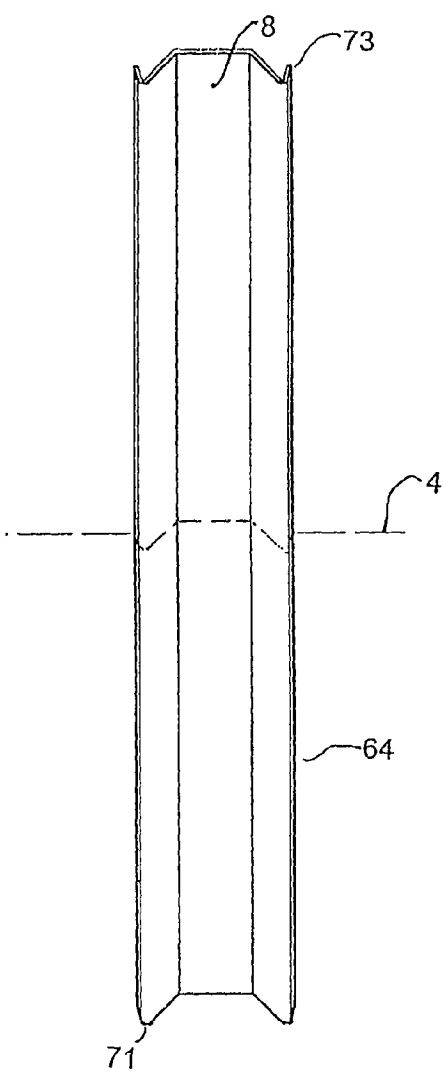
FIG. 9 shows the sleeve of FIG. 8 rotated about its lengthwise axis through 180°.
Figure 8:
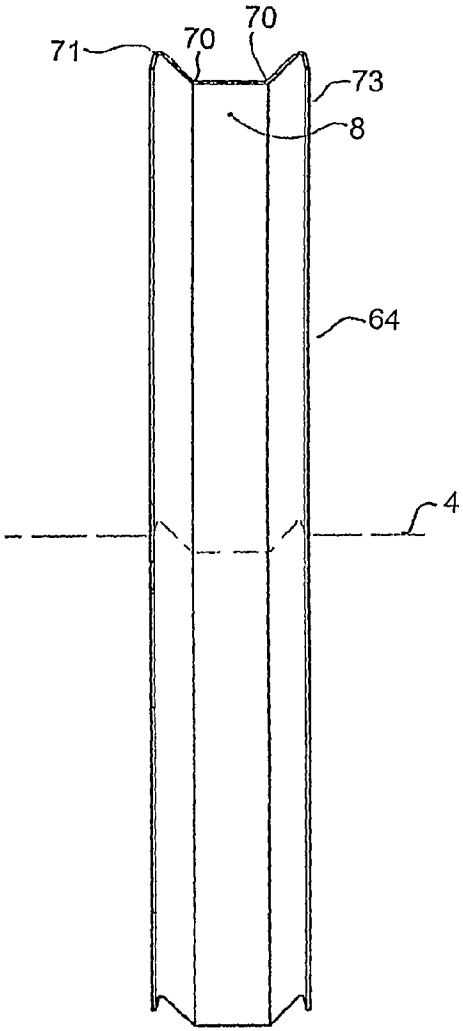
FIG. 8 shows an elevational view of a sleeve for use with a bridging beam according to the invention.

Referring to FIGS. 6, 8 and 9, the bridging beam generally designated 60 is shown secured to a pole 63 by strapping surrounding the bridging beam and pole, the ends of the strapping being joined by the connector 76.

The bridging beam comprises a sleeve 64 formed of pressed steel with press bends 70 in the central region of the sleeve and press bends 71 at the edges of the sleeve forming the flanges 73.

A generally C-shaped secondary member 66 pressed from steel and formed with a number of press bends 68 has been shaped so as to allow its edges to fit within the channel formed between the body of the sleeve and the flanges 73.

The assembly of the bridging beam against a pole shown in FIG. 6 can be carried out in similar manner to that already described with reference to FIGS. 1 to 3 in that the sleeve is initially driven into the ground next to the pole. This is followed by locating the secondary member against the sleeve and sliding it into the ground in contact with the sleeve. Subsequently, several rows of strapping may be applied at different levels along the height of the pole to secure the bridging beam to the pole. As in the case of the previous embodiments, the combination of the secondary member and sleeve forms a box section which adds considerable strength to the bridging beam.

Figure 7:
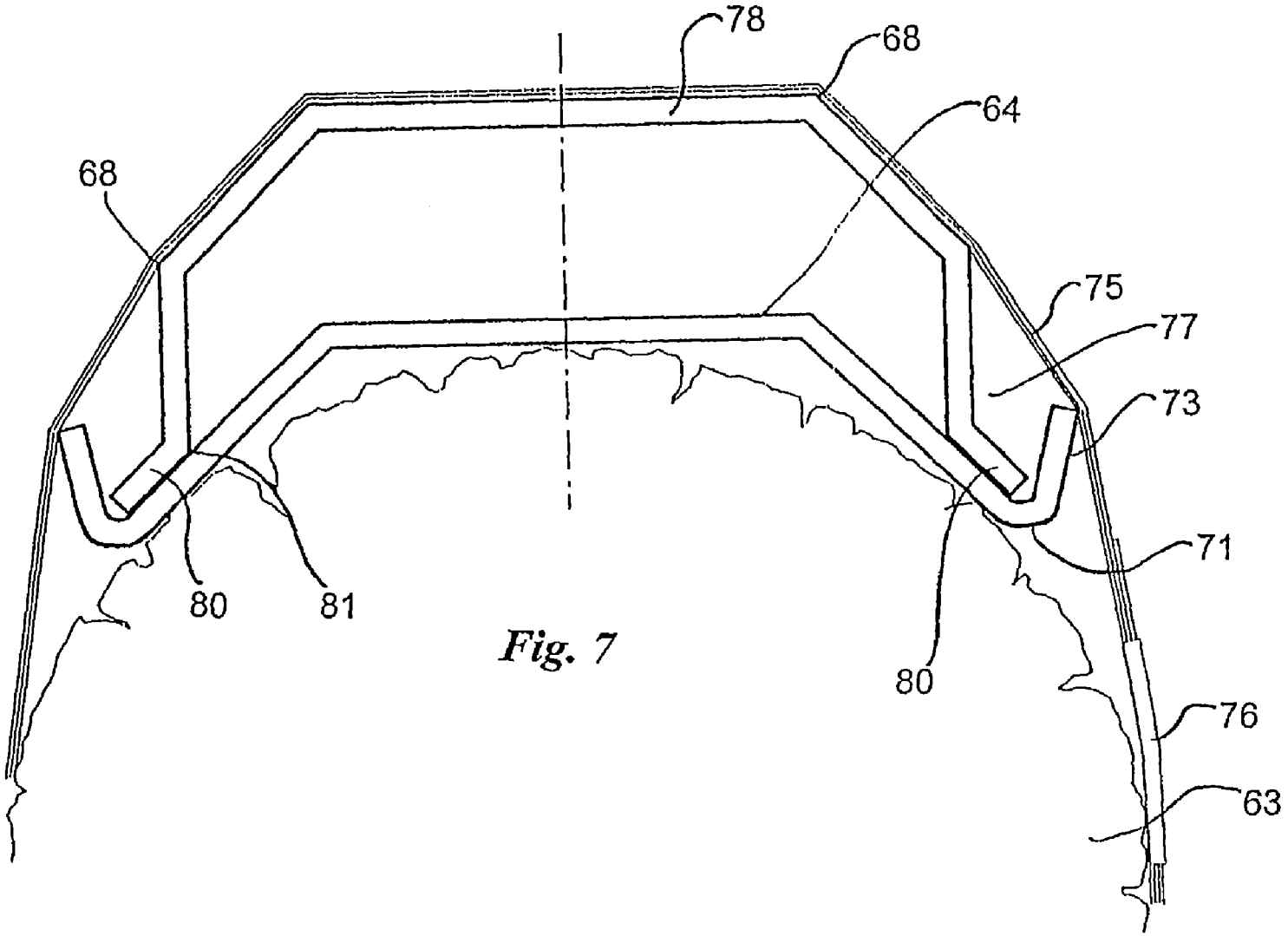
FIG. 7 shows a further alternative of a bridging beam construction according to the invention.

Referring to FIG. 7, there is shown a bridging beam 77 similar to that described with reference to FIG. 6 in that it includes a sleeve 64 as shown in FIGS. 8 and 9 identical to that shown with reference to FIG. 6 and strapping 75 also holds the bridging beam in place in the same manner.

The main significant difference between FIGS. 6 and 7 is that the secondary member 78 includes a reverse bend 81 extending lengthwise near each of its terminal edges. The reverse bend forms an extended leg 80 for location in the recess formed between the flange 73 and body of the sleeve 64.

Installation of the bridging beam will be along similar lines to that described with reference to FIGS. 1 and 6.

Whilst the above description includes the preferred embodiments of the invention, it is to be understood that many variations, alterations, modifications and/or additions may be introduced into the constructions and arrangements of parts previously described without departing from the essential features or the spirit or ambit of the invention.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

The reference to any prior art in this specification is not, and should not be taken as, an acknowledgment or any form of suggestion that such prior art forms part of the common general knowledge in Australia.

The invention claimed is:

1. A method for reinstating a pole standing in ground comprising, abutting an inner surface of a sleeve against an outer surface of the pole so as to have a lower portion of the sleeve penetrating the ground and an upper portion of the sleeve projecting above the ground, and sliding a secondary member against an outer surface of the sleeve so that the secondary member locates against the sleeve and projects above the ground and into the ground, wherein the construction is such that the sleeve and secondary member located against the sleeve jointly form a bridging beam incorporating a box section reinforcement of the bridging beam, and wherein, in the region of the box section reinforcement, the sleeve and secondary member are spaced apart from one another so as to form a gap therebetween.

2. A method according to claim 1 wherein the bridging beam is secured to the pole by at least one of, bolts extending through the pole, and strapping surrounding the pole.

3. A method according to claim 2 wherein the securement comprises between two and twelve metal strips surrounding the pole and bridging beam at different positions along the length of the pole.

4. A method according to claim 2 wherein the securement comprises a plurality of bolts extending through the pole and bridging beam.

5. A method according to claim 1 wherein the secondary member has longitudinal edges which come into locking engagement with upturned longitudinal edges of the sleeve when the secondary member is slid into position against the sleeve.

6. A method according to claim 5 wherein the bridging beam is secured to the pole by a plurality of bolts extending through the pole and the bridging beam including through the secondary member.

7. A bridging beam comprising:

a sleeve having an inner surface for abutting against a pole;

locating means on an outer surface of the sleeve; and a secondary member slidable into reinforcing engagement with the locating means, wherein the secondary member is shaped such that it jointly forms a reinforcing box section with the sleeve when it is slid into reinforcing engagement with the locating means, and wherein, in the region of the box section reinforcement, the sleeve and secondary member are spaced apart from one another so as to form a gap therebetween.

8. A bridging beam according to claim 7 wherein the sleeve and secondary member comprise steel sheet which has been shaped by pressing the steel sheet.

9. A bridging beam according to claim 7 wherein the sleeve comprises opposed upturned longitudinal edges.

10. A bridging beam according to claim 9 wherein the longitudinal edges each define one side of a channel.

11. A bridging beam according to claim 7 wherein the secondary member comprises longitudinally extending flanges formed on opposed sides of the secondary member.

12. A bridging beam according to claim 7 wherein the sleeve and secondary member are shaped so as to be held in locking engagement when the two are slid together.

13. A bridging beam according to claim 7 wherein the sleeve is formed with a tapered end.

14. A bridging beam according to claim 7 wherein the sleeve and secondary member each comprise a plurality of holes therethrough, the plurality of holes being located such that the holes on the sleeve line up with the holes on the secondary member when they are fitted together to jointly form a box section.

15. A bridging beam according to claim 7 wherein the secondary member has a generally C-shaped cross section.

16. A pole reinstated with a bridging beam according to the method of claim 1.

* * * * *